US008866726B2

(12) United States Patent
Choi et al.

(10) Patent No.: US 8,866,726 B2
(45) Date of Patent: Oct. 21, 2014

(54) BACKLIGHT ASSEMBLY

(75) Inventors: Kyung-Uk Choi, Asan-si (KR); Sang-Gil Lee, Seoul (KR); Yun-Jae Park, Yongin-si (KR); Seung-Hwan Moon, Yongin-si (KR)

(73) Assignee: Samsung Display Co., Ltd., Yongin, Gyeonggi-Do (KR)

( * ) Notice: Subject to any disclaimer, the term of this patent is extended or adjusted under 35 U.S.C. 154(b) by 1009 days.

(21) Appl. No.: 12/416,405

(22) Filed: Apr. 1, 2009

(65) Prior Publication Data

US 2010/0085296 A1 Apr. 8, 2010

(30) Foreign Application Priority Data

Oct. 6, 2008 (KR) ..... 2008-97855

(51) Int. Cl.
*G09G 3/36* (2006.01)
*G09G 3/34* (2006.01)

(52) U.S. Cl.
CPC ..... *G09G 3/3426* (2013.01); *G09G 2330/04* (2013.01)
USPC ..... 345/102; 345/100; 345/690

(58) Field of Classification Search
USPC ..... 345/102
See application file for complete search history.

(56) References Cited

U.S. PATENT DOCUMENTS

| | | | | |
|---|---|---|---|---|
| 4,070,648 | A * | 1/1978 | Mergenthaler et al. | 714/18 |
| 6,472,927 | B1 * | 10/2002 | Desroches | 327/538 |
| 2003/0011559 | A1 * | 1/2003 | Adachi et al. | 345/102 |
| 2005/0012702 | A1 * | 1/2005 | Kim | 345/98 |
| 2005/0200590 | A1 * | 9/2005 | Kumekawa | 345/100 |
| 2008/0180386 | A1 * | 7/2008 | Liao et al. | 345/102 |
| 2009/0167194 | A1 * | 7/2009 | Mizuta | 315/151 |

FOREIGN PATENT DOCUMENTS

| | | |
|---|---|---|
| KR | 20-0114567 | 4/1998 |
| KR | 1020070072340 | 7/2007 |

* cited by examiner

*Primary Examiner* — Sumati Lefkowitz
*Assistant Examiner* — Jose Soto Lopez
(74) *Attorney, Agent, or Firm* — F. Chau & Associates, LLC

(57) ABSTRACT

A backlight assembly includes a light source unit, at least one block driving unit, a controller unit and a noise removing circuit. The light source unit includes a plurality of dimming blocks generating light. The block driving unit drives the dimming blocks. The controller unit controls the block driving unit. The noise removing circuit is connected to the block driving unit and the controller unit to prevent noise from being applied to a reset terminal of the block driving unit.

15 Claims, 5 Drawing Sheets

BACKLIGHT ASSEMBLY

CROSS-REFERENCE TO RELATED APPLICATIONS

This application claims priority to Korean Patent Application No. 2008-97855, filed on Oct. 6, 2008 in the Korean Intellectual Property Office (KIPO), the disclosure of which is incorporated by reference in its entirety herein.

BACKGROUND OF THE INVENTION

1. Technical Field

Exemplary embodiments of the present invention relate to a backlight assembly, and more specifically to a backlight assembly providing light to a liquid crystal display (LCD) panel.

2. Discussion of Related Art

A liquid crystal display (LCD) device may include an LCD panel which displays an image by controlling the light transmissivity of liquid crystal and a backlight assembly disposed below the LCD panel to provide light to the LCD panel.

The LCD panel includes an array substrate, a color filter substrate and a liquid crystal layer. The array substrate includes a plurality of pixel electrodes and a plurality of thin-film transistors (TFTs) electrically connected to the pixel electrodes. The color filter substrate includes a common electrode and a plurality of color filters. The liquid crystal layer is interposed between the array substrate and the color filter substrate. The arrangement of liquid crystal molecules of the liquid crystal layer is altered by an electric field formed between the pixel electrodes and the common electrode, thereby changing the light transmissivity of the liquid crystal layer.

The backlight assembly includes a light source unit generating light and an optical member disposed at an upper portion of the light source unit. The light source unit may include a cold cathode fluorescent lamp (CCFL). However, the light source unit may instead include a light-emitting diode (LED), which may improve display quality and color reproducibility.

In a backlight assembly having a plurality of LEDs, a dimming technology may be used to reduce power consumption and increase contrast ratio (CR). For example, the LEDs may be divided into a plurality of dimming blocks, which are individually driven.

A block driving unit and a controller unit may be used to drive the dimming blocks. The block driving unit is electrically connected to the dimming blocks to individually drive each of the dimming blocks. The controller unit is electrically connected to the block driving unit. The controller unit controls the block driving unit by providing a control signal to the block driving unit.

However, when the control signal provided from the controller unit to the block driving unit includes external noise, the block driving unit may malfunction, so that the dimming blocks are not driven according to normal data.

Thus, there is a need for a backlight assembly that can prevent malfunctions from being generated due to noise.

SUMMARY OF THE INVENTION

According to an exemplary embodiment of the present invention, a backlight assembly includes a light source unit, at least one block driving unit, a controller unit and a noise removing circuit. The light source unit includes a plurality of dimming blocks. The block driving unit drives the dimming blocks. The controller unit controls the block driving unit.

The noise removing circuit is connected to the block driving unit and the controller unit to prevent noise from being applied to a reset terminal of the block driving unit.

The controller unit may output a data signal, a clock signal, a reset signal and a shutdown signal. The data signal may be transmitted to a data terminal of the block driving unit to control the dimming blocks. The clock signal may be transmitted to a clock terminal of the block driving unit to synchronize the data signal. The reset signal may be transmitted to the reset terminal of the block driving unit to reset the block driving unit. The shutdown signal may be transmitted to a shutdown terminal of the block driving unit to determine whether or not the block driving unit operates.

An operation of the block driving unit for driving the dimming blocks may be stopped when the shutdown signal is at a low logic level, and the block driving unit may drive the dimming blocks according to the data signal when the shutdown signal is at a certain high logic level. An internal register memory in the block driving unit may be set according to the data signal when the shutdown signal is at a low logic level and the reset signal is at a high logic level.

The noise removing circuit may remove noise transmitted to the reset terminal of the block driving unit, when the shutdown signal is at a high logic level. The noise removing circuit may include a transistor for removing the noise. A source terminal of the transistor may be electrically connected to the reset terminal of the block driving unit, a drain terminal of the transistor may be connected to an external ground terminal, and a gate terminal of the transistor may receive the shutdown signal to turn a channel of the transistor on and off. The transistor may include a bipolar junction transistor (BJT).

The noise removing circuit may further include a first resistor, a second resistor and a capacitor. The first resistor and the second resistor may be serially connected to the gate terminal of the transistor and a shutdown output terminal of the controller unit. The capacitor may be connected between a central node between the first resistor and the second resistor, and the ground terminal of the transistor.

According to an exemplary embodiment of the present invention, a backlight assembly includes a light source unit, at least one block driving unit and a controller unit. The light source unit includes a plurality of dimming blocks generating light. The block driving unit drives the dimming blocks. The controller unit is configured to provide a data signal including a parity bit to the block driving unit when noise is present on a reset terminal of the block driving unit. The block driving unit may be configured to be reset when the parity bit is present.

The controller unit may transmit the data signal, for controlling the dimming blocks, to a data terminal of the block driving unit; transmit a clock signal, which synchronizes the data signal, to a clock terminal of the block driving unit; transmit the reset signal, for resetting the block driving unit, to the reset terminal of the block driving unit; and transmit a shutdown signal, which determines whether the block driving unit operates or not, to a shutdown terminal of the block driving unit.

An operation of the block driving unit for driving the dimming blocks may be stopped when the shutdown signal is at a low logic level, and the block driving unit may drive the dimming blocks according to the data signal when the shutdown signal is at a high logic level. An internal register memory of the block driving unit may be set according to the data signal when the shutdown signal is at a low logic level and the reset signal is at a high logic level.

The data signal applied when setting the register memory may include the parity bit. The block driving unit may include a parity bit detecting part determining whether or not the parity bit is included in the data signal received from the controller unit.

According to an exemplary embodiment of the present invention, a backlight assembly includes a light source unit, at least one block driving unit, a controller unit and a system reactivating circuit. The light source unit includes a plurality of dimming blocks generating light. The block driving unit drives the dimming blocks. The controller unit controls the block driving unit. The system reactivating circuit is configured to reactivate at least one of the controller unit and the block driving unit when noise is applied to a reset terminal of the block driving unit.

The backlight assembly may further include a power generating unit providing power to the controller unit and the block driving unit. The power may include a plurality of different power voltages. The system reactivating circuit may reset the power generating unit when the noise applied to the reset terminal of the block driving unit is applied, to block the power from being applied to the controller unit and the block driving unit during a predetermined period.

The controller unit may transmit the data signal, for controlling the dimming blocks, to a data terminal of the block driving unit; transmit a clock signal, which synchronizes the data signal, to a clock terminal of the block driving unit; transmit a reset signal, for resetting the block driving unit, to the reset terminal of the block driving unit; and transmit a shutdown signal, which determines whether or not the block driving unit operates, to a shutdown terminal of the block driving unit.

An operation of the block driving unit for driving the dimming blocks may be stopped when the shutdown signal is at a low logic level, and the block driving unit may drive the dimming blocks according to the data signal when the shutdown signal is at a high logic level. An internal register memory in the block driving unit may be set according to the data signal, when the shutdown signal is at a low logic level and the reset signal is at a high logic level.

The system reactivating circuit may reset the power generating unit, when a signal applied to the reset terminal of the block driving unit is at a high logic level and the shutdown signal is at a high logic level.

According to an exemplary embodiment of the present invention, a backlight assembly includes a light source unit, at least one block driving unit, a controller unit and a register maintaining circuit. The light source unit includes a plurality of dimming blocks generating light. The block driving unit drives the dimming blocks. The controller unit controls the block driving unit. The register maintaining circuit maintains a register value stored in a register memory of the block driving unit, when noise is applied to a reset terminal of the block driving unit.

The controller unit may transmit the data signal, for controlling the dimming blocks, to a data terminal of the block driving unit; transmit a clock signal, which synchronizes the data signal, to a clock terminal of the block driving unit; transmit the reset signal, for resetting the block driving unit, to the reset terminal of the block driving unit; and transmit a shutdown signal, determining whether or not the block driving unit operates, to a shutdown terminal of the block driving unit.

An operation of the block driving unit for driving the dimming blocks may be stopped when the shutdown signal is at a low logic level, the block driving unit may drive the dimming blocks according to the data signal when the shutdown signal is at a high logic level. An internal register memory in the block driving unit may be set according to the data signal, when the shutdown signal is at a low logic level and the reset signal is at a high logic level.

According to at least one exemplary embodiment of the present invention, noise applied to a reset terminal of a block driving unit through a noise removing circuit may be removed. Noise may be sensed by including a parity bit in a data signal. When noise is generated, the backlight assembly may be reactivated or a register setting value may be maintained. Thus, the block driving unit may be prevented from malfunctioning due to the noise applied to the reset terminal of the block driving unit.

BRIEF DESCRIPTION OF THE DRAWINGS

The present invention will become more apparent by describing in detailed exemplary embodiments thereof with reference to the accompanying drawings, in which.

DETAILED DESCRIPTION OF EXEMPLARY EMBODIMENTS

The present invention is described more fully hereinafter with reference to the accompanying drawings, in which exemplary embodiments are shown. The present invention may, however, be embodied in many different forms and should not be construed as limited to the exemplary embodiments set forth herein.

It will be understood that when an element or layer is referred to as being "on," "connected to" or "coupled to" another element or layer, it can be directly on, connected or coupled to the other element or layer or intervening elements or layers may be present. Like numerals refer to like elements throughout. Hereinafter, exemplary embodiments of the present invention will be explained in detail with reference to the accompanying drawings.

Figure 1:
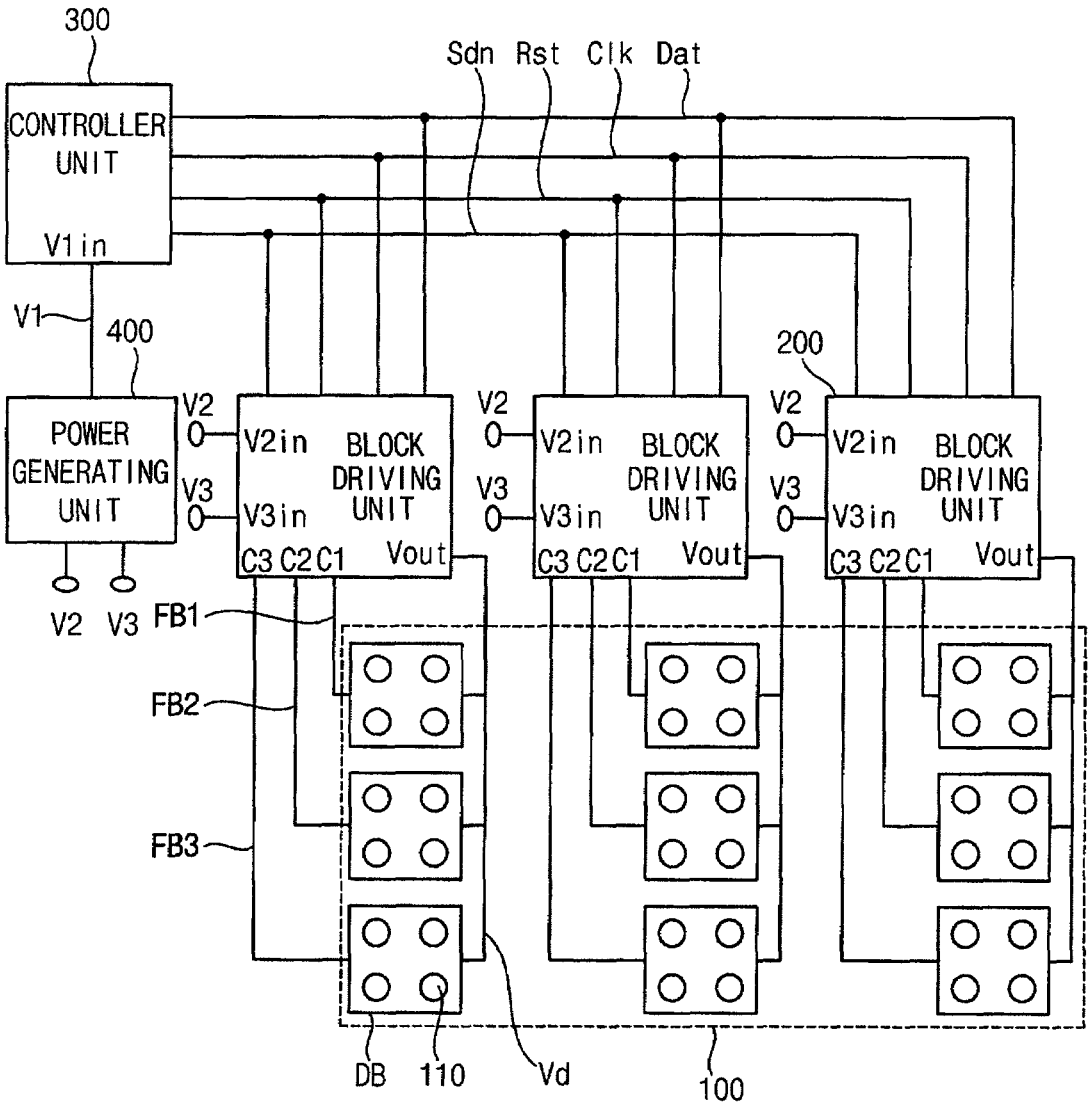
FIG. 1 is a block diagram schematically illustrating a backlight assembly according to an exemplary embodiment of the present invention.

FIG. 1 is a block diagram schematically illustrating a backlight assembly according to an exemplary embodiment of the present invention. Referring to FIG. 1, the backlight assembly includes a light source unit 100, a plurality of block driving units 200, a controller unit 300 and a power generating unit 400.

The light source unit 100 includes a plurality of dimming blocks DB generating light and arranged in a matrix form. The plurality of dimming blocks DB includes a plurality of light-emitting diodes (LEDs) 110, respectively. The LEDs 110 may include red LEDs, green LEDs and blue LEDs, or include white LEDs.

Each of the block driving units 200 may drive at least one block of the dimming blocks DB. For example, one block driving unit 200 may drive three dimming blocks DB as shown in FIG. 1.

For example, first ends of the three dimming blocks 200 may be connected to a driving voltage output terminal Vout of the block driving unit 200 and second ends of the three dimming blocks 200 opposite to the first ends may be connected in a one-to-one correspondence respectively to a first channel C1, a second channel C2, and a third channel C3 of the block driving unit 200. A driving voltage Vd outputted from the driving voltage output terminal Vout of the block driving unit 200 is applied to the first ends of the three dimming blocks DB. A first feedback signal FB1 to a third feedback signal FB3 outputted respectively from a corresponding one of the second ends of the three dimming blocks DB are applied to the first channel C1 to the third channel C3, respectively. Therefore, the block driving unit 200 may individually control each of the dimming blocks DB, using the first feedback signal FB1 to the third feedback signal FB3.

Figure 2:
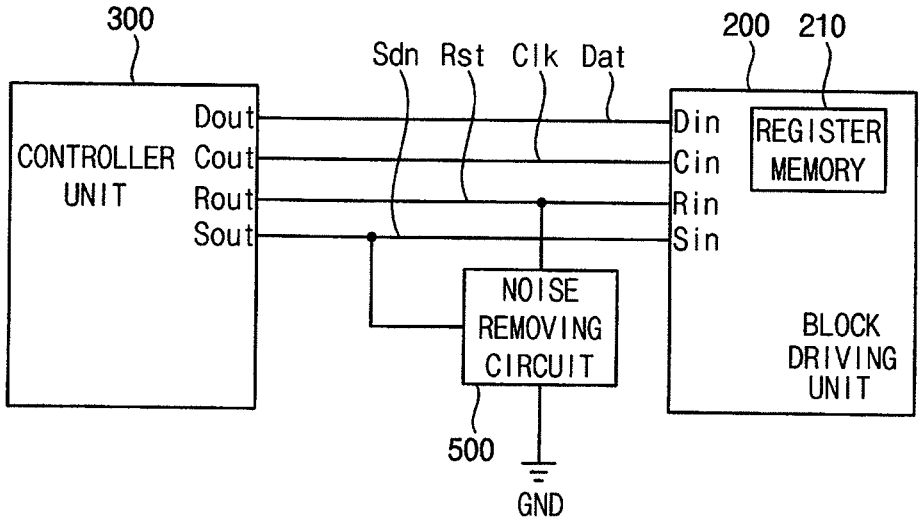
FIG. 2 is a block diagram schematically illustrating a relationship among a block driving unit, a controller unit and a noise removing circuit of the backlight assembly of FIG. 1.

The controller unit 300 receives an image signal (not shown) from an external device and generates a variety of signals in response to the image signal. Referring to FIG. 2, the controller unit 300 outputs a data signal Dat through a data output terminal Dout, outputs a clock signal Clk through a clock output terminal Cout, outputs a reset signal Rst through a reset output terminal Rout, and outputs a shutdown signal Sdn through a shutdown output terminal Sout.

The data output terminal Dout of the controller unit 300 is connected to data terminals Din of the block driving units 200, respectively, to apply the data signal Dat to each of the block driving units 200. The clock output terminal Cout of the controller unit 300 is connected to clock terminals Cin of the block driving units 200, respectively, to apply the clock signal Clk to each of the block driving units 200. The reset output terminal Rout of the controller unit 300 is connected to reset terminals Rin of the block driving units 200, respectively, to apply the reset signal Rst to each of the block driving units 200. The shutdown output terminal Sout of the controller unit 300 is connected to shutdown terminals Sin of the block driving units 200, respectively, to apply the shutdown signal Sdn to each of the block driving units 200. The controller unit 300 may receive and transmit signals to/from the block driving units 200 using a serial communication method.

The data signal Dat may include a first data with respect to a dimming duty of each of the dimming blocks DB, or a second data for setting a resistor of the block driving units 200. The clock signal Clk synchronizes the data signal Dat, the reset signal Rst and the shutdown signal Sdn. The reset signal Rst resets the block driving unit 200. The shutdown signal Sdn determines whether or not the block driving unit 200 operates. For example, when the shutdown signal Sdn is at a low logic level, the block driving unit 200 for driving the dimming blocks DB stops operating. When the shutdown signal is at a high logic level, the block driving unit 200 may drive the dimming blocks DB according to the first data of the data signal Dat.

The power generating unit 400 may generate various kinds of power for driving a system, using external power (not shown) applied from the external device. For example, the power generating unit 400 may generate a first voltage V1, a second voltage, and a third voltage V3.

The first voltage V1 is applied to a first voltage input terminal V1in of the controller unit 300 to drive the controller unit 300. As an example, the first voltage V1 may be about 3.3 V.

The second voltage V2 is applied to second voltage input terminals V2in of the block driving units 200 to drive the block driving units 200. As an example, the second voltage V2 may be at least one of about 3.3 V and about 5 V.

The third voltage V3 is applied to third voltage input terminals V3in of the block driving units 200, respectively, for conversion by the block driving units 200 into the driving voltage Vd. As an example, the third voltage V3 may be about 24 V and the driving voltage Vd may be about 36 V.

Figure 3:
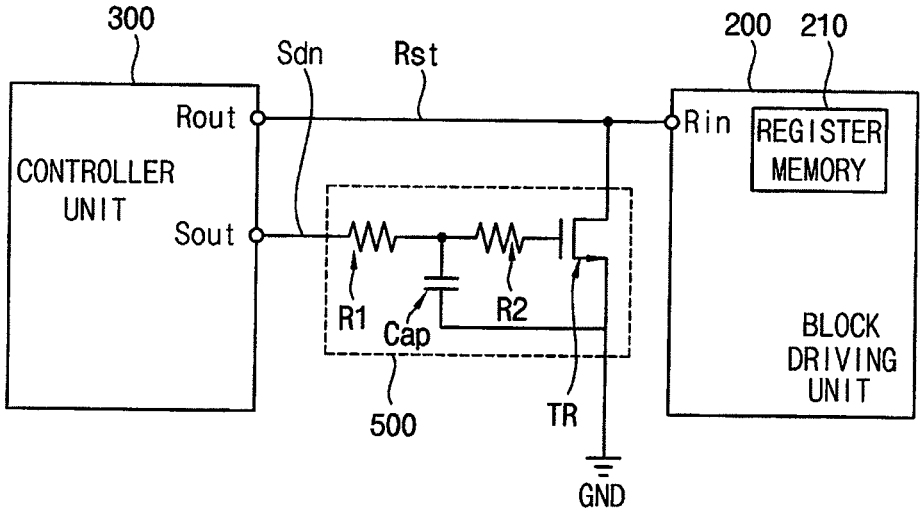
FIG. 3 is a block diagram schematically illustrating an exemplary embodiment of the noise removing circuit of FIG. 2.

FIG. 2 is a block diagram schematically illustrating a relationship among a block driving unit, a controller unit and a noise removing circuit of the backlight assembly of FIG. 1. FIG. 3 is a block diagram schematically illustrating an exemplary embodiment of the noise removing circuit of FIG. 2.

Referring to FIGS. 2 and 3, a noise removing circuit 500 is disposed between the block driving unit 200 and the controller unit 300. The noise removing circuit 500 prevents noise from being applied to the reset terminal Rin of the block driving unit 200. A noise removing circuit 500 may be disposed to correspond to a respective one of each of the block driving units 200. Alternately, a single noise removing circuit 500 may be disposed to correspond to all of the block driving units 200.

The noise removing circuit 500 is connected to the reset terminal Rin of the block driving unit 200, the shutdown output terminal Sout of the controller unit 200, and a ground terminal GND, respectively. The noise removing circuit 500 may remove the noise from the reset terminal Rin of the block driving unit 200 by sending the noise to the ground terminal GND.

For example, the noise removing circuit 500 may include a transistor TR, a first resistor R1, a second resistor R2 and a capacitor Cap. A source terminal of the transistor TR is electrically connected to the reset terminal Rin of the block driving unit 200, a drain terminal of the transistor TR is connected to the ground terminal GND, and a gate terminal of the transistor TR is connected to the shutdown output terminal Sout of the controller unit 300. The shutdown signal Sdn outputted from the shutdown output terminal Sout of the controller unit 300 is applied to the gate terminal of the transistor TR to turn a channel of the transistor TR on and off. The transistor TR may be, for example, a bipolar junction transistor (BJT).

The first resistor R1 and the second resistor R2 may be serially connected to the gate terminal of the transistor TR and the shutdown output terminal Sout of the controller unit 300. Here the capacitor Cap is connected to a central node between the first resistor R1 and the second resistor R2, and the ground terminal GND. For example, the first resistor R1 and the second resistor R2 may have the same value, about 4.7 kΩ, the capacitor Cap may have a value of about 100 nF.

Figure 4:
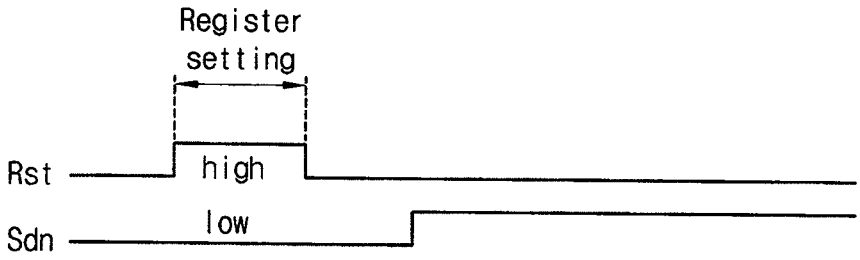
FIG. 4 is an exemplary waveform diagram of a reset signal and a shutdown signal of FIG. 2.

FIG. 4 is an exemplary waveform diagram of a reset signal and a shutdown signal of FIG. 2. Referring to FIGS. 2, 3 and 4, the block driving unit 200 includes a register memory 210 for setting a register. Register setting in the register memory 210 may occur during a register setting period in which the shutdown signal Sdn is at a low logic level and the reset signal is at a high logic level. For example, as the second data of the data signal inputted through the data terminal Din of the block driving units 200 is stored in the register memory 210 during the register setting period, the register setting may be attained.

When external noise is applied to the reset terminal Rin of the block driving unit 200 outside of the register setting period, the block driving unit 200 may recognize a non-register setting period as a register setting period, so that the register setting may occur using the wrong data. Thus, the block driving unit 200 may malfunction.

However, when the shutdown signal Sdn is at a high logic level, the noise removing circuit 500 turns the transistor TR on, so that the noise applied to the reset terminal Rin of the block driving unit 200 may be removed.

Therefore, the noise removing circuit 500 may remove the noise applied to the reset terminal Rin of the block driving unit 200, and thus the block driving unit 200 may be prevented from malfunctioning due to the noise.

Figure 5:
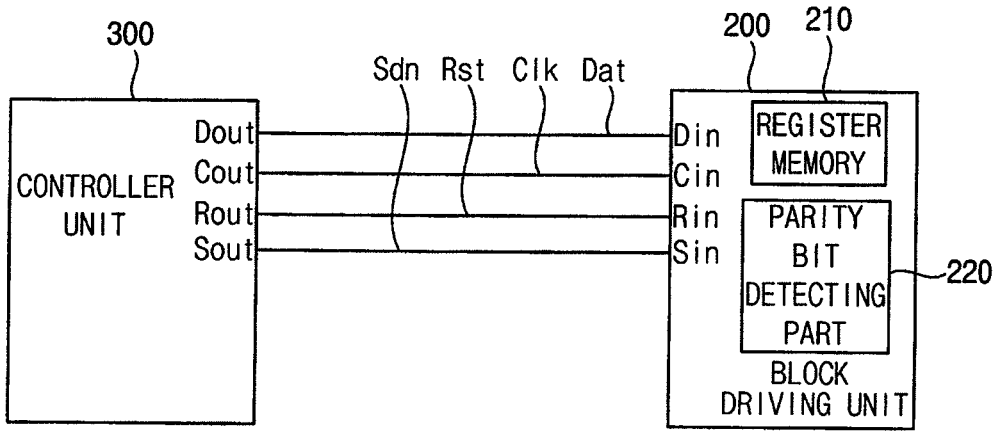
FIG. 5 is a block diagram schematically illustrating a relationship among a block driving unit and a controller unit of a backlight assembly according to an exemplary embodiment of the present invention.
Figure 6:
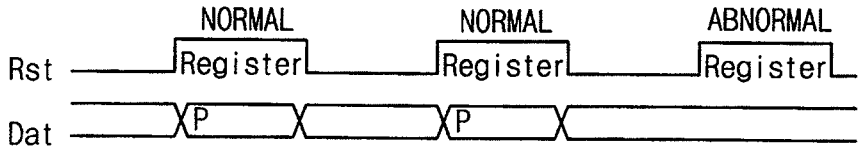
FIG. 6 is an exemplary waveform diagram of a reset signal and a data signal of FIG. 5.

FIG. 5 is a block diagram schematically illustrating a relationship among a block driving unit and a controller unit of a backlight assembly according to an exemplary embodiment of the present invention. FIG. 6 is an exemplary waveform diagram of a reset signal and a data signal of FIG. 5.

Since the backlight assembly of FIG. 5 is substantially the same as the backlight assembly in FIGS. 1 to 4 except for some parts of a block driving unit 200 and a controller unit 300, a detailed description about other components except for the block driving unit 200 and the controller unit 300 will be omitted. The same reference numerals used in FIGS. 1 to 4 will be used to refer to components that are substantially the same as those in the backlight assembly of FIG. 5.

Referring to FIGS. 5 and 6, when the block driving unit 200 is register set, the controller unit 300 transmits a data signal Dat including a parity bit to a data terminal Din of the block driving unit 200.

The register setting in the register memory 210 occurs during a register setting period in which the shutdown signal Sdn is at a low logic level and the reset signal is at a high logic level. For example, as the data signal inputted through a data terminal Din of the block driving unit 200 is stored in the register memory 210 during the register setting period, the register setting may be attained.

However, when external noise is applied to the reset terminal Rin of the block driving unit 200, the block driving unit 200 may attain the register setting using the wrong data even outside of the register setting period.

Accordingly, the data signal Dat transmitted to the block driving unit 200 during the register setting period includes a parity bit, and thus whether or not the block driving unit 200 is to be reset may be determined based on the presence or absence of the parity bit.

The block driving unit 200 of FIG. 5 may further comprise a parity bit detecting part 220 that can determine whether or not the data signal Dat applied from the controller unit 300 during the register setting period includes a parity bit. The parity bit detecting part 220 determines whether or not the data signal Dat includes a parity bit, so that a register value may be maintained without resetting the register memory 210, when the data signal Dat does not include the parity bit.

Since the block driving unit 200 of FIG. 5 comprises a parity bit detecting part 220 determining whether or not the data signal Dat includes a parity bit, malfunctions may be prevented from being generated by the noise applied to the reset terminal Rin.

Figure 7:
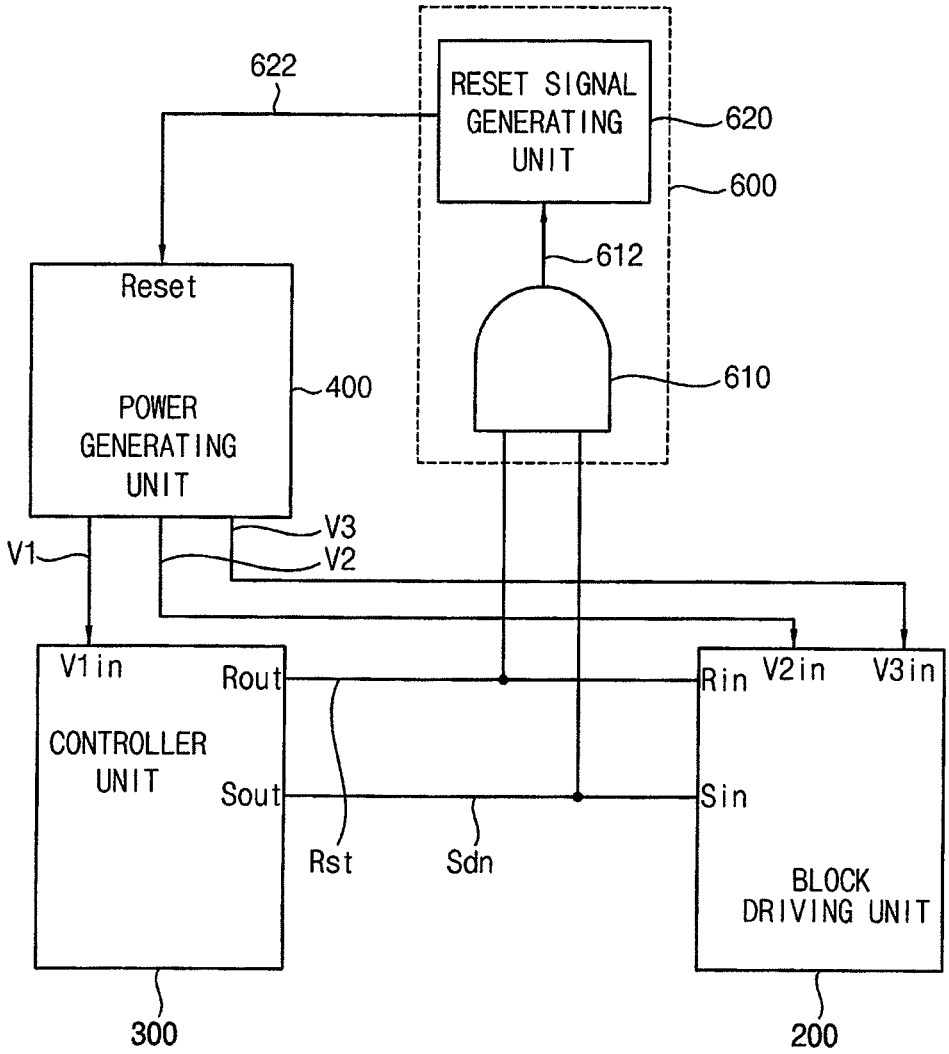
FIG. 7 is a block diagram schematically illustrating a relationship among a block driving unit, a controller unit, a power generating unit and a system reactivating circuit of a backlight assembly according to an exemplary embodiment of the present invention.
Figure 8:
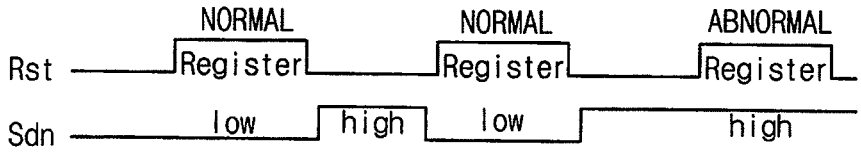
FIG. 8 is an exemplary waveform diagram of a reset signal and a shutdown signal of FIG. 7.

FIG. 7 is a block diagram schematically illustrating a relationship among a block driving unit, a controller unit, a power generating unit and a system reactivating circuit of a backlight assembly according to an exemplary embodiment of the present invention. FIG. 8 is an exemplary waveform diagram of a reset signal and a shutdown signal of FIG. 7.

Since a backlight assembly of FIG. 7 is substantially the same as the backlight assembly described in FIGS. 1 to 4 except for a system reactivating circuit 600, a detailed description with respect to other components except for the system reactivating circuit 600 will be omitted. The same reference numerals used in FIGS. 1 to 4 will be used for components that are substantially the same as those in the backlight assembly of FIG. 7.

Referring to FIGS. 7 and 8, the backlight assembly includes a system reactivating circuit 600. The system reactivating circuit 600 reactivates at least one of the controller unit 300 and the block driving unit 200 to prevent the block driving unit 200 from malfunctioning, when noise is applied to a reset terminal Rin of the block driving unit 200. For example, the system reactivating circuit 600 resets the power generating unit 400 to block various kinds of power from being applied to the controller unit 300 and the block driving unit 200 during a predetermined period, when noise applied to the reset terminal Rin of the block driving unit 200 is applied.

The system reactivating circuit 600 may include an AND gate 610 and a reset signal generating part 620. The AND gate 610 outputs an AND gate control signal 612 into the reset signal generating part 620, when a signal applied to the reset terminal Rin of the block driving unit 200 is at a high logic level and the shutdown signal Sdn is at a high logic level. The reset signal generating part 620 outputs a power reset signal 622 into the reset terminal Reset of the power generating unit 400 in response to the AND gate control signal 612. The power generating unit 400 blocks the first power V1, the second power V2 and the third power V3 from being applied to the controller unit 300 and the block driving unit 200 in response to the power reset signal 622 during a predetermined period. As a result, the controller unit 300 and the block driving unit 200 reactivate, and thus the block driving unit 200 may be prevented from malfunctioning by the noise.

Since the backlight assembly of FIG. 7 comprises the system reactivating circuit 600 reactivating at least one of the controller unit 300 and the block driving unit 200 when noise is applied to the reset terminal Rin of the block driving unit 200, the block driving unit 200 may be prevented from malfunctioning.

Figure 9:
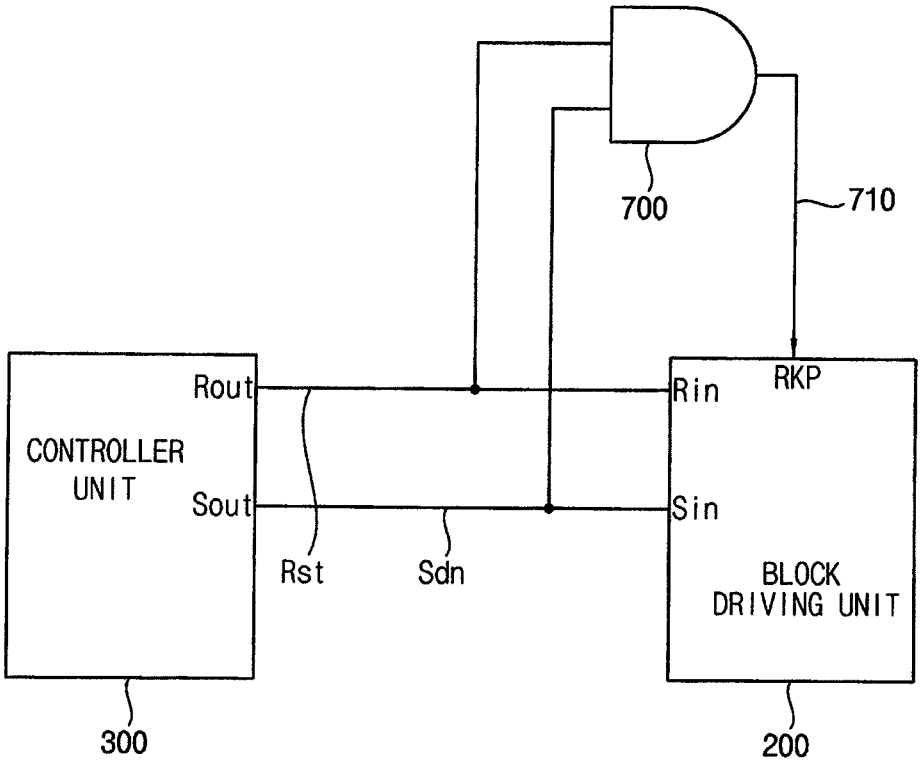
FIG. 9 is a block diagram schematically illustrating a relationship among a block driving unit, a controller unit and a register maintaining circuit of a backlight assembly according to an exemplary embodiment of the present invention.

FIG. 9 is a block diagram schematically illustrating a relationship among a block driving unit, a controller unit and a register maintaining circuit of a backlight assembly according to an exemplary embodiment of the present invention.

Since a backlight assembly of FIG. 9 is substantially the same as a backlight assembly described in FIGS. 1 to 4 except for a register maintaining circuit 700, a detailed description with respect to other components except for the register maintaining circuit 700 will be omitted. The same reference numerals used in FIGS. 1 to 6 will be used for components that are substantially the same as those in the backlight assembly of FIG. 9.

Referring to FIG. 9, the backlight assembly includes a register maintaining circuit 700. The register maintaining circuit 700 maintains a register value stored in the register memory 210 of the block driving unit 200 to prevent the block driving unit 200 from malfunctioning, when noise is applied to the reset terminal Rin of the block driving unit 200.

For example, the register maintaining circuit 700 may include a maintaining circuit AND gate. The maintaining circuit AND gate outputs a register maintaining signal 710 into a register maintaining terminal RKP of the block driving unit 200, when a signal applied to the reset terminal Rin of the block driving unit 200 is at a high logic level and the shutdown signal Sdn is at a high logic level. The block driving unit 200 may be controlled by the register maintaining signal 710 to maintain the register value stored in the register memory 210. As a result, the block driving unit 200 may be prevented from malfunctioning due to noise applied to the reset terminal Rin of the block driving unit 200.

The backlight assembly of FIG. 9 may prevent the block driving unit 200 from malfunctioning, by including the register maintaining circuit 700 maintaining the register value stored in the register memory 210 of the block driving unit 200, when noise is applied to the reset terminal Rin of the block driving unit 200.

According to at least one exemplary embodiment of the present invention, noise applied to a reset terminal of a block driving unit through a noise removing circuit may be removed. A parity bit may be included in a data signal to determine whether noise is present. When noise is present, the entire system may be reactivated or a register setting value may be maintained. Thus, the block driving unit may be prevented from malfunctioning due to the noise applied to the reset terminal of the block driving unit.

Although exemplary embodiments of the present invention have been described, those skilled in the art will readily appreciate that various modifications can be made without departing from the spirit and the scope of the disclosure. Accordingly, all such modifications are intended to be included within the scope of the disclosure.

What is claimed is:

1. A backlight assembly comprising:

a light source unit comprising a plurality of dimming blocks;

at least one block driving unit driving the dimming blocks;

a controller unit controlling the block driving unit; and a noise removing circuit connected to the block driving unit and the controller unit to remove noise from a reset terminal of the block driving unit, wherein the controller unit:

transmits a data signal, for controlling the dimming blocks, to a data terminal of the block driving unit;

transmits a clock signal, which synchronizes the data signal, to a clock terminal of the block driving unit;

transmits a reset signal, for resetting the block driving unit, to the reset terminal of the block driving unit; and transmits a shutdown signal, which determines whether the block driving unit operates, to a shutdown terminal of the block driving unit, wherein each dimming block includes at least one light-emitting diode, wherein a first signal line connects the controller unit to the reset terminal for transmission of the reset signal, and wherein a second other signal line provides an output of the noise removing unit to the reset terminal.

2. The backlight assembly of claim 1, wherein an operation of the block driving unit for driving the dimming blocks is stopped when the shutdown signal is at a low logic level, and the block driving unit drives the dimming blocks in accordance with the data signal when the shutdown signal is at a high logic level, an internal register memory of the block driving unit is set in accordance with the data signal when the shutdown signal is at a low logic level and the reset signal is at a high logic level, and the noise removing circuit being configured to remove the noise transmitted to the reset terminal of the block driving unit when the shutdown signal is at a high logic level.

3. The backlight assembly of claim 2, wherein the noise removing circuit comprises:

a transistor, the transistor including a source terminal electrically connected to the reset terminal of the block driving unit;

a drain terminal connected to an external ground terminal; and a gate terminal receiving the shutdown signal to turn a channel of the transistor on and off.

4. The backlight assembly of claim 3, wherein the transistor comprises a bipolar junction transistor (BJT).

5. The backlight assembly of claim 3, wherein the noise removing circuit comprises:

a first resistor and a second resistor serially connected to the gate terminal of the transistor and a shutdown output terminal of the controller unit; and a capacitor connected to a central node between the first resistor and the second resistor, and the ground terminal of the transistor.

6. A backlight assembly comprising:

a light source unit comprising a plurality of dimming blocks generating light;

at least one block driving unit driving the dimming blocks;

a controller unit controlling the block driving unit; and a system reactivating circuit configured to reactivate at least one of the controller unit and the block driving unit when noise is present on a reset terminal of a block driving unit, wherein an internal register memory in the block driving unit is set according to a data signal when a shutdown signal applied to a shutdown terminal of the block driving unit is at a first logic level and a reset signal at the reset terminal is at a second other logic level, wherein each block includes at least one light emitting diode, wherein a first signal line connects the controller unit to the reset terminal for transmission of the reset signal, wherein a second other signal line connects the controller unit to the shutdown terminal for transmission of the shutdown signal.

7. The backlight assembly of claim 6, further comprising:

a power generating unit providing power to the controller unit and the block driving unit.

8. The backlight assembly of claim 7, wherein the system reactivating circuit resets the power generating unit when the noise applied to the reset terminal of the block driving unit is applied, to block the power from being applied to the controller unit and the block driving unit during a predetermined time interval.

9. The backlight assembly of claim 8, wherein the controller unit:

transmits the data signal, for controlling the dimming blocks, to a data terminal of the block driving unit;

transmits a clock signal, which synchronizes the data signal, to a clock terminal of the block driving unit;

transmits a reset signal, for resetting the block driving unit, to the reset terminal of the block driving unit; and transmits a shutdown signal, which determines whether the block driving unit operates, to a shutdown terminal of the block driving unit.

10. The backlight assembly of claim 9, wherein an operation of the block driving unit for driving the dimming blocks is stopped when the shutdown signal is at a low logic level, the block driving unit drives the dimming blocks according to the data signal when the shutdown signal is at a high logic level, and the internal register memory in the block driving unit is set according to the data signal, when the shutdown signal is at a low logic level and the reset signal is at a high logic level.

11. The backlight assembly of claim 10, wherein the system reactivating circuit resets the power generating unit, when a signal applied to the reset terminal of the block driving unit is at a high logic level and the shutdown signal is at a high logic level.

12. The backlight assembly of claim 6 further comprising:

a register maintaining circuit maintaining a register value stored in the internal register memory of the block driving unit, when noise is applied to the reset terminal of the block driving unit.

13. The backlight assembly of claim 12, wherein the controller unit:

transmits the data signal, for controlling the dimming blocks, to a data terminal of the block driving unit;

transmits a clock signal, which synchronizes the data signal, to a clock terminal of the block driving unit;

transmits the reset signal, for resetting the block driving unit, to the reset terminal of the block driving unit; and transmits a shutdown signal, determining whether the block driving unit operates, to a shutdown terminal of the block driving unit.

14. The backlight assembly of claim 13, wherein an operation of the block driving unit for driving the dimming blocks stops operating when the shutdown signal is at a low logic level, and the block driving unit drives the dimming blocks according to the data signal when the shutdown signal is at a high logic level, wherein the internal register memory in the block driving unit is set according to the data signal, when the shutdown signal is at a low logic level and the reset signal is at a high logic level.

15. The backlight assembly of claim 6, wherein the system reactivating circuit considers the noise to be present when both the shutdown signal and the reset signal are at the same second logic level.

* * * * *